US010763564B2

(12) United States Patent
Koo et al.

(10) Patent No.: US 10,763,564 B2
(45) Date of Patent: Sep. 1, 2020

(54) CAVITY FILTER FOR LOW PIMD USING HYBRID CAP BOLT

(71) Applicant: ACE TECHNOLOGIES CORPORATION, Incheon (KR)

(72) Inventors: Jae Yong Koo, Bucheon-si (KR); Sin Jae Kim, Incheon (KR); Se Young O, Incheon (KR); Sang Yong Lee, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 36 days.

(21) Appl. No.: 16/009,480

(22) Filed: Jun. 15, 2018

(65) Prior Publication Data

US 2018/0366802 A1 Dec. 20, 2018

(30) Foreign Application Priority Data

Jun. 15, 2017 (KR) ..... 10-2017-0075665

(51) Int. Cl.

| | |
|---|---|
| ***H01P 1/208*** | (2006.01) |
| ***H01P 7/06*** | (2006.01) |
| ***H01P 1/207*** | (2006.01) |
| ***H01P 1/205*** | (2006.01) |

(52) U.S. Cl.

CPC ..... *H01P 1/208* (2013.01); *H01P 1/207* (2013.01); *H01P 1/2053* (2013.01); *H01P 7/06* (2013.01)

(58) Field of Classification Search

CPC .. H01P 7/06; H01P 1/208; H01P 1/207; H01P 1/2053

USPC ..... 333/206–209

See application file for complete search history.

(56) References Cited

U.S. PATENT DOCUMENTS 6,384,699 B1 * 5/2002 Henningsson ..... H01P 7/04 333/202
2002/0084866 A1 * 7/2002 Henningsson ..... H01P 5/04 333/24 R

FOREIGN PATENT DOCUMENTS

KR 10-2016-0008486 A 1/2016
KR 20160055664 A * 5/2016

OTHER PUBLICATIONS

KR-20160055664-A, English translation (Year: 2016).*

* cited by examiner

*Primary Examiner* — Rakesh B Patel
(74) *Attorney, Agent, or Firm* — LRK Patent Law Firm

(57) ABSTRACT

A cavity filter for low PIMD using hybrid cap bolts includes: a housing having therein a plurality of cavities partitioned by separation walls and an open upper portion; an upper plate coupled onto the upper portion of the housing and provided therein with a plurality of tuning bolts; a plurality of air blowing work holes formed respectively on the upper plate and outer sidewalls of the housing and corresponding to the plurality of cavities; and a plurality of hybrid cap bolts formed of different kinds of materials of metal and non-metal so as to have repulsive forces against and to be coupled to respective plurality of air blowing work holes. Thus, metal debris present inside a cavity housing are removed through an air blowing method by using an air blowing work hole formed in a cavity housing and a hybrid cap bolt for reducing PIMD.

4 Claims, 3 Drawing Sheets

CAVITY FILTER FOR LOW PIMD USING HYBRID CAP BOLT

CROSS REFERENCE TO RELATED APPLICATION

This application claims priority to Korean Patent Application No. 10-2017-0075665, filed Jun. 15, 2017, which is hereby incorporated by reference in its entirety into this application.

BACKGROUND OF THE INVENTION

1. Field of the Invention

The present invention relates to a cavity filter for low PIMD using hybrid cap bolts, and more particularly, to a cavity filter for low PIMD using hybrid cap bolts which can remove metal debris present inside a cavity housing by an air blowing method using air blowing work holes formed in a cavity housing and hybrid cap bolts for reducing PIMD while effectively preventing the generation of additional metal debris.

2. Description of Related Art

Along with evolution of mobile communication technology, the data transmission speed is being geometrically increased, and in order to improve transceiving sensitivity according to the increase in data transmission, the transmission power of a base station is gradually increasing.

A duplexer, which is used as an indispensable apparatus to prevent interference between transmitting and receiving terminals in such a base station, is mainly implemented by using an aluminum coaxial resonator having a high power resistant characteristic to endure high power.

In addition, the duplexer used in the base station requires a steep skirt property, and hence is very sensitive to a mechanical tolerance. A filter characteristic required by the duplexer may be achieved by adjusting a resonant frequency using a metal tuning screw on an upper cover of a housing constituting a coaxial resonator.

Meanwhile, in a filter which is a passive element, intermodulation may be generated from a nonlinear property due to an incomplete metallic contact, metal debris, dirt, etc., and this phenomenon is referred to as passive intermodulation distortion (PIMD).

Among these PIMD causing factors, metal debris, which is generated, by screw coupling, from a metallic tuning screw formed in the upper cover of the housing constituting a coaxial resonator and a tap section accommodating the metallic tuning screw, acts as the most critical factor from among various error causing factors.

Thus, there is a strong demand for a practical and applicable technique capable of effectively removing metal debris introduced into the housing constituting the coaxial resonator to reduce a PIM signal.

SUMMARY

The present invention has been devised to solve the aforementioned problems, and is to provide a cavity filter for low PIMD using hybrid cap bolts, which can remove metal debris present inside a cavity housing by an air blowing method using air blowing work holes formed in a cavity housing and hybrid cap bolts for reducing PIMD while effectively preventing the generation of additional metal debris.

In addition, the present invention is to form the outer surface of a main body of a hybrid cap bolt of an ULTEM (polyetherimide (PEI) resin plastic) material, thereby allowing the hybrid cap bolt to be firmly fixed with a repulsive force when the hybrid cap bolt is screwed into an air blowing work hole.

A cavity filter for low PIMD using hybrid cap bolts according to the present invention may include: a housing having therein a plurality of cavities partitioned by separation walls and an open upper portion; an upper plate coupled onto the upper portion of the housing and provided therein with a plurality of tuning bolts; a plurality of air blowing work holes formed respectively on the upper plate and outer sidewalls of the housing and corresponding to the plurality of cavities; and a plurality of hybrid cap bolts formed of different kinds of materials of metal and non-metal so as to be coupled to respective plurality of air blowing work holes while having a repulsive force against the air blowing work holes.

The plurality of hybrid cap bolts may each include: a main body inserted into each of the air blowing work holes; and a coupling thread formed of a dielectric material by an injection molding on an outer surface of the main body and provided on an outside thereof with threads for being coupled to the air blowing work holes.

The coupling threads may be formed by forming the main body by an insert injection molding method.

The coupling threads may be made of an ULTEM material.

The air blowing work holes, to which the coupling threads are coupled, may each include a groove part on which a main body cap section of each of the hybrid cap bolts is mounted.

The coupling threads may each be maintained at a state of being coupled, while having a repulsive force, to and fixed to threads formed in an inner surface of each air blowing work hole when coupled to the air blowing work hole.

The plurality of air blowing work holes may be provided such that a blowing work is performed to blow air through the air blowing work holes formed in the upper plate, and a suctioning work is performed through the air blowing work holes formed in the outer sidewall of the housing.

As described above, the present invention has an effect of providing a cavity filter for low PIMD using hybrid cap bolts, which can remove metal debris present inside a cavity housing by an air blowing method using air blowing work holes formed in a cavity housing and hybrid cap bolts for reducing PIMD while effectively preventing the generation of additional metal debris.

In addition, the present invention has an effect in that the outer surface of the main body of each hybrid cap bolt is formed of an ULTEM material and thus the hybrid cap is firmly fixed with a repulsive force when the hybrid cap bolt is screwed into the air blowing work hole.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Description of the present invention is merely an exemplary embodiment for structural or functional description. Therefore, the scope of the present invention should not be construed as limited by the embodiments described in the description. That is, the embodiment may have various modifications and a variety of forms, and hence the scope of the invention should be understood to include equivalents for realizing the technical concept.

Meanwhile, the meanings of terms described in this invention are to be understood as follows.

Terms such as "first", "second" are used to distinguish one element from the other, and the scope of the invention should not be limited by these terms. For example, a first component may be referred to as a second component. Likewise, the second component may also be referred to as the first component.

It should also be understood that when a component is referred to as being "connected to" another component, it can be directly connected to another element, but an intervening component may also be present therebetween. In contrast, it will be understood that when a component is referred to as being "directly connected" to another component, another intervening component is not present therebetween. Meanwhile, other expressions used to describe the relationship between elements, such as "between", "directly-between", "adjacent to", and "directly adjacent to", should be interpreted similarly.

A singular expression should be understood to include plural forms as well unless the context clearly indicates otherwise. The meaning of 'include' or 'have' specifies the presence of a feature, a number, a step, an operation, a component, a part, or a combination thereof, but does not exclude in advance the presence or addition of other features, numbers, steps, operations, components, parts or a combinations thereof.

In each of the steps, identifiers (e.g. a, b, c) are used for convenience of description, and the identifiers do not describe the order of respective steps. Each of the steps may occur differently in the order stated, unless a specific order is described explicitly in the context. That is, each of the steps may take place as in the stated order, also be actually performed at the same time, and also be substantially performed in the opposite order.

Unless terms used in the present disclosure are defined differently, the terms may be construed as a meaning known to those skilled in the art. Such terms as those defined in a generally used dictionary are to be interpreted as consistent with the meaning in the context of the relevant art. Unless explicitly defined in the present invention, the terms cannot be interpreted as having an ideal or overly formal meaning.

Hereinafter, a preferred embodiment of the present invention will be described with reference to the accompanying drawings.

Figure 1:
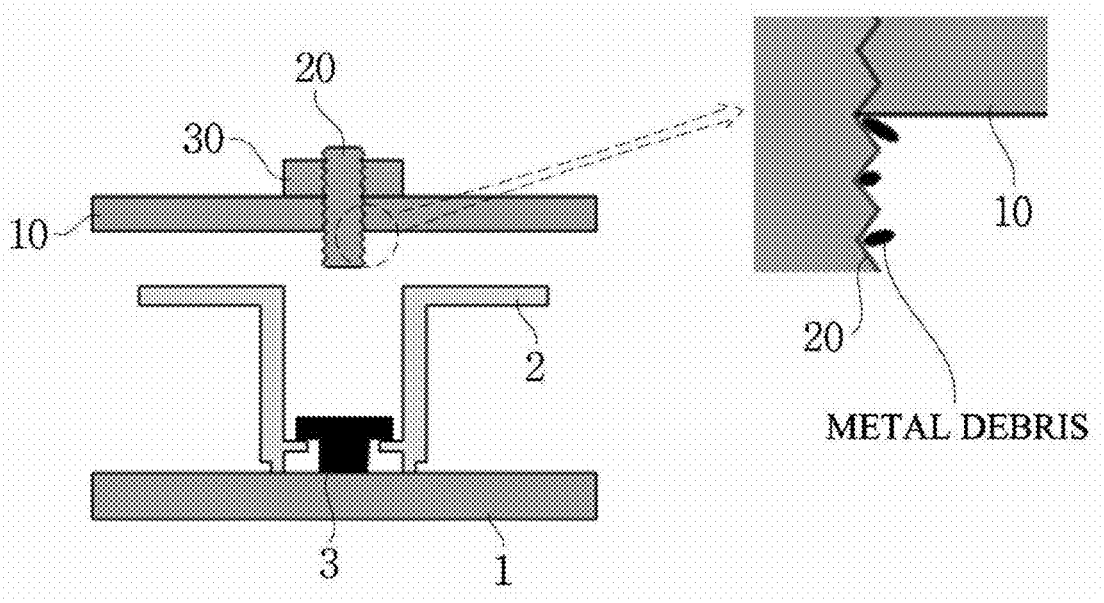
FIG. 1 RELATED ART
FIG. 1 is a view for illustrating an inner structure of a cavity filter according to a conventional art.

FIG. 1 is an inner configuration view of a cavity filter using a coaxial resonator structure according to a conventional art.

As illustrated in FIG. 1, a filter using a coaxial resonator structure according to a conventional art is provided with: a housing 1 which forms a cavity therein; a resonator 2, a fastening screw 3 which fixes the resonator 2 to the cavity; an upper plate 10 coupled to an open upper portion of the housing 1; a tuning screw 20 installed to pass through the upper plate 10; and a nut 30 for permanently fixing the tuning screw.

Here, the cavity filter according to the conventional art has a structure in which metal debris is inevitably generated at a contact portion of the upper plate 10 according to the rotation of the tuning screw 20.

In order to solve the above-mentioned problem, a cavity filter according to an embodiment of the present invention to be described in detail with reference to FIGS. 2 to 6 intended to remove metal debris generated due to the tuning screw 20 described above in detail in such a way that: a plurality of air blowing work holes 11 and 110 were formed in an upper plate 10 and an outer sidewall 100 of the housing 1 at positions corresponding to a cavity; air was blown through the work holes 11 formed in the upper plate 10 of the housing; and an air suctioning operation was performed through the work holes 110 formed in the outer sidewall 100 of the housing.

Meanwhile, while implementing the present invention, after performing the air blowing operation and the suctioning operation to remove the metal debris from the inside of the cavity, there was a try to seal the inside of the cavity using the existing tuning screws 20 into the air blowing work holes 11 and 110 formed in the upper plate 10 and the outer sidewall 100 of the housing 1. However, as described in the conventional problem, when the metallic tuning screws 20 were equally used, there was a problem in that metal debris was generated through the work holes 11 and 110.

In addition, in order to prevent this, there was proposed a try to cover, with a conductive sticker, the portion in which the air blowing work holes 11 and 110 were formed, but there was a problem in that the conductive sticker lacks electromagnetic wave-shielding performance, and hence the use thereof was limited.

Thus, in the present invention, the air blowing work holes 11 and 110 formed in the upper plate 10 and the outer sidewall 100 of the housing 1 are sealed by using hybrid cap bolts formed of different materials, and thus, the generation of metal debris can be completely prevented and an electromagnetic wave-shielding effect can also be achieved.

Hereinafter with reference to FIGS. 2 to 6, a cavity filter for low PIMD using hybrid cap bolts according to an embodiment of the present invention will be described in detail as follows.

Figure 2:
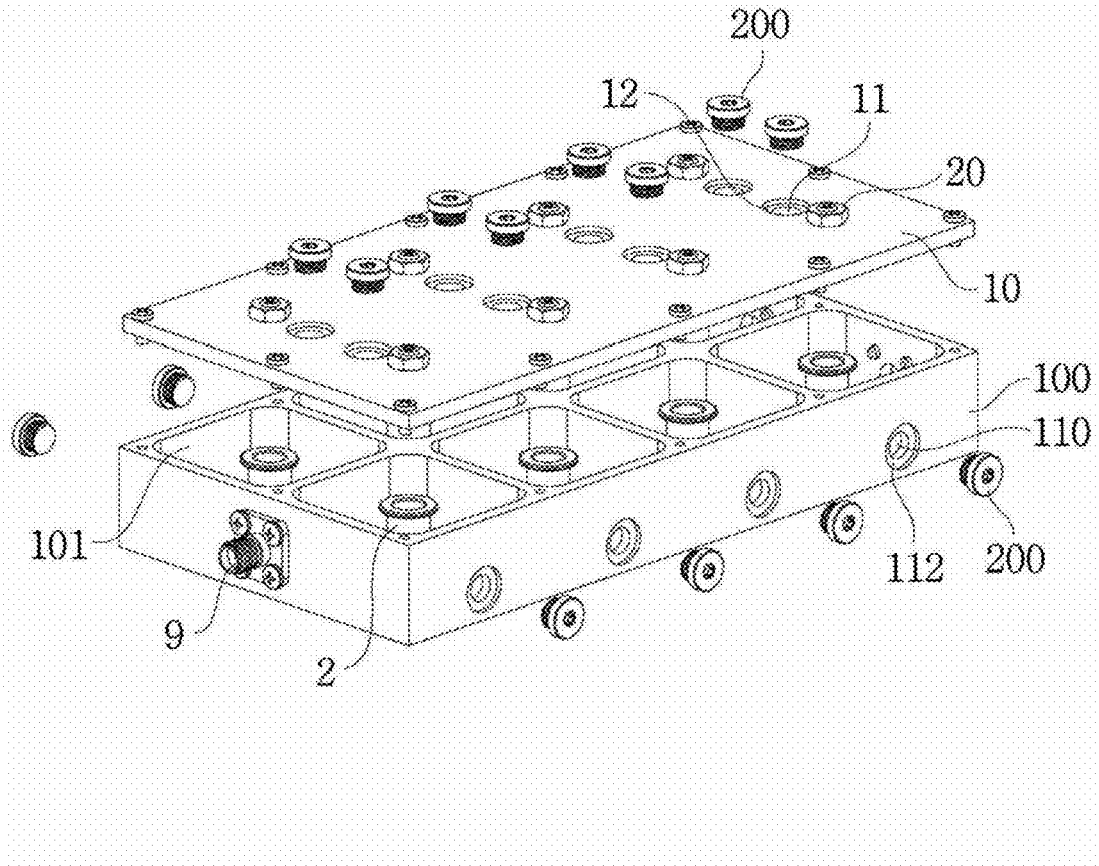
FIG. 2 is an exploded view of a cavity filter for low PIMD using hybrid cap bolts according to an embodiment of the present invention.
Figure 3:
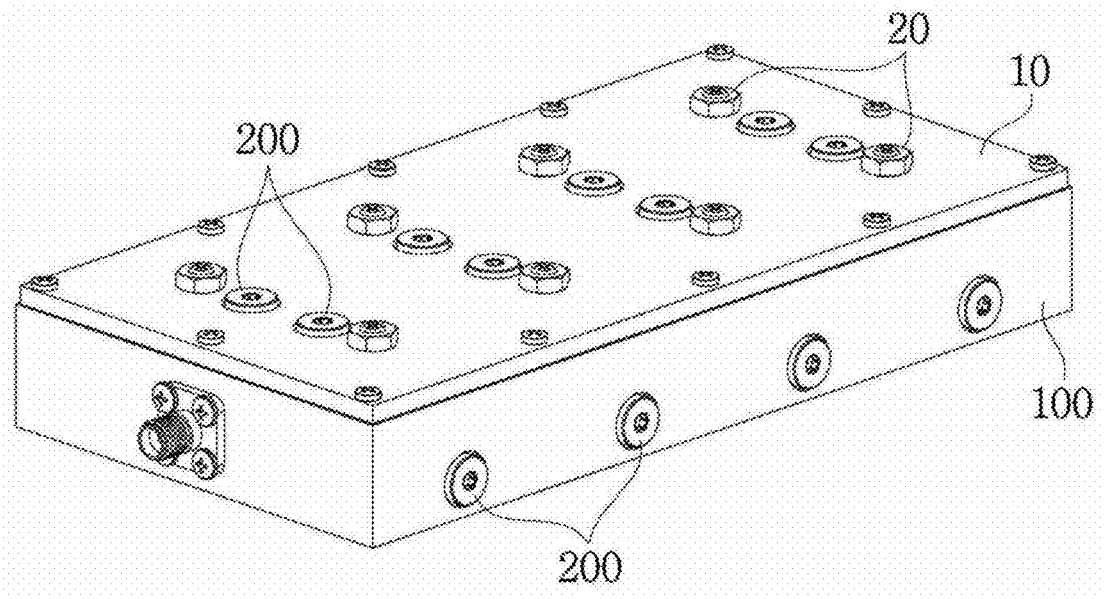
FIG. 3 is a view illustrating an assembled outer configuration of the cavity filter for low PIMD using hybrid cap bolts illustrated in FIG. 2.

FIG. 2 is an exploded view of a cavity filter for low PIMD using hybrid cap bolts according to an embodiment of the present invention, and FIG. 3 is a view illustrating an assembled outer configuration of the cavity filter for low PIMD using hybrid cap bolts illustrated in FIG. 2.

As illustrated in the drawings, a cavity filter for low PIMD using hybrid cap bolts according to an embodiment of the present invention may be provided with a housing 1, resonators 2, an upper plate 10, air blowing work holes 11 and 110, and hybrid cap bolts 200.

More specifically, the housing 1 is equipped with an input/output connector 9, a plurality of cavities 101 are partitioned by separation walls 102 inside the housing 1, and the housing 1 may have an open upper portion.

Specifically, the input/output connector 9 of the housing 1 is installed inside the housing 1 from the outside of the housing 1, and although not shown in the drawings, the inside and outside of the housing may be electrically connected by means of a transmission line selectively formed for signal transmission.

In addition, the resonators 2 may be installed in plurality on the plurality of cavities 101 so as to be perpendicular to respective cavities 101, and the upper plate 10 may be provided with a plurality of tuning bolts 20 installed above the resonators 2 to be in one-to-one correspondence with the plurality of resonators 2.

Meanwhile, the plurality of air blowing work holes 11 and 110 formed for an air blowing work according to an embodiment of the present invention may be formed respectively corresponding to the plurality of cavities 101 in the upper plate 10 and the outer sidewall 100 of the housing.

Figure 4:
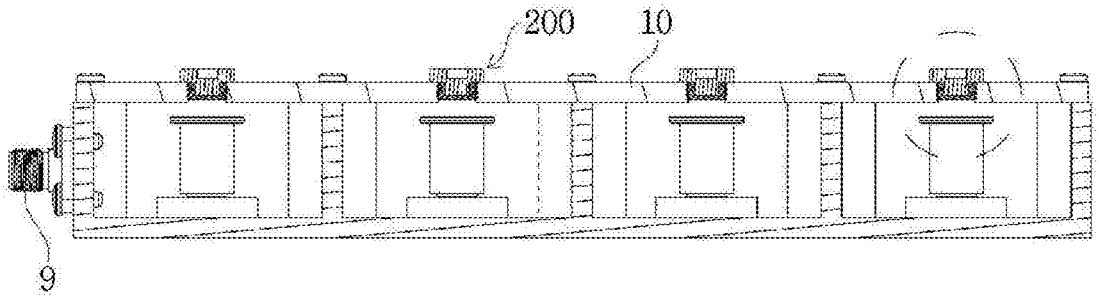
FIG. 4 is a schematic view illustrating a state in which hybrid cap bolts are coupled to an upper plate of the cavity filter illustrated in FIGS. 2 to 3.
Figure 5:
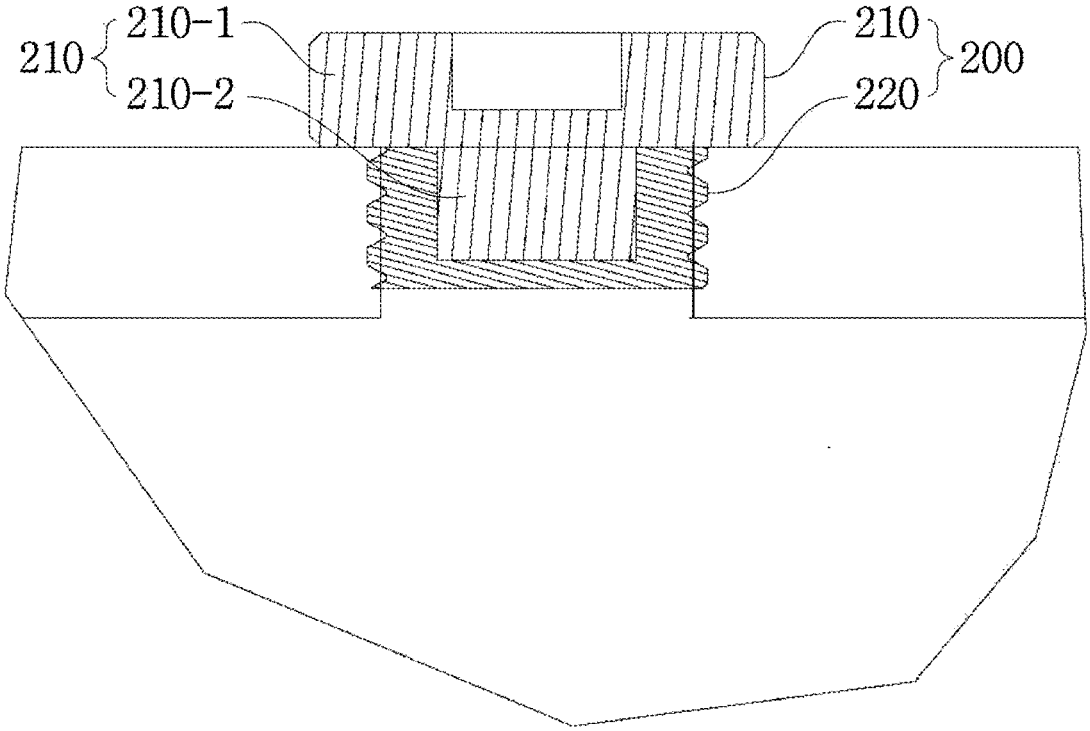
FIG. 5 is an expanded view for describing in detail the hybrid cap bolt illustrated in FIG. 4.

FIG. 4 is a schematic view illustrating a state in which hybrid cap bolts are coupled to an upper plate of the cavity filter illustrated in FIGS. 2 to 3, and FIG. 5 is an expanded view for describing in detail the hybrid cap bolts illustrated in FIG. 4.

As illustrated in FIGS. 4 and 5, a hybrid cap bolt 200 applied to the embodiment of the present invention may be provided with a main body 210 and a coupling thread 220 surrounding a portion of the main body 210.

The hybrid cap bolt 200 is formed of different kinds of materials of metal and non-metal so as to be coupled to, while having a repulsive force to, the plurality of air blowing work holes 11 and 110.

That is, the main body 210 of the hybrid cap bolt 200 may be formed of a metallic material, and the coupling thread 220 surrounding a portion of the main body 210 is formed of a non-metallic material.

The metallic main body 210 is configured from: a cap section 210-1 mounted on the upper plate 10 or the outer sidewall 100 of the housing; and a body section 210-2 the outer surface of which is surrounded the coupling thread 220.

The non-metallic coupling thread 220 surrounding the outer surface of the body section 210-2 of the main body 210 is made of an ULTEM (polyetherimide (PEI) resin plastic) material, and threads are formed on the outer surface the coupling thread.

Here, the ULTEM material, which is the material for the coupling thread 220 of the hybrid cap bolt 200, is used as a special heat-processable material, is strong against heat and shock, and is made of a lightweight material, thereby being characterized by having excellent durability.

More specifically, the hybrid cap bolt 200 corresponds to the bolt inserted into the air blowing work holes 11 and 110, and in the embodiment of the present invention, the cap section 210-1 and the body section 210-2 may be formed of an integrated metal material.

At this point, the coupling thread 220 may be formed of an ULTEM material by an injection molding on the outer surface of the body section 210-2 of the main body 210, and be provided, on the outer portion thereof, with threads for being coupled to the air blowing work holes 11 and 110.

Meanwhile, in the embodiment of the present invention, the coupling thread 220 may be formed by forming the main body 210 through an insert injection molding method.

Figure 6:
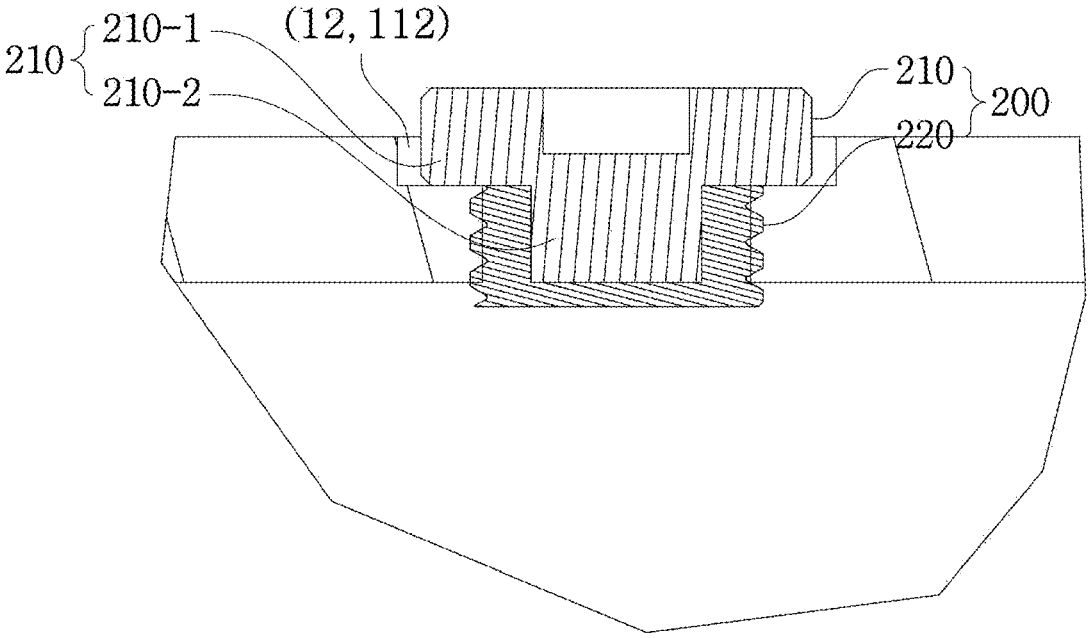
FIG. 6 is a view in which a hybrid cap bolt is coupled to an upper plate or an outer sidewall of the cavity filter illustrated in FIGS. 2 to 3 according to another embodiment.

FIG. 6 is a view in which a hybrid cap bolt is coupled to an upper plate or an outer sidewall of the cavity filter illustrated in FIGS. 2 to 3 according to another embodiment.

As illustrated, air blowing work holes 11 and 110 to which the coupling threads 220 are coupled may respectively be provided with groove sections 12 and 112 in each of which the cap section 210-1 of the main body of the hybrid cap bolt 200 is mounted.

In addition, in the embodiment of the present invention, the coupling threads 220, when being coupled to the air blowing work holes 11 and 110, may be maintained at a firmly fixed state so as to be coupled to, while having a repulsive force to, the threads formed in the inner surfaces of the air blowing work holes 11 and 110.

As illustrated in the drawings, the cavity filter according to the embodiment of the present invention may suppress the generation of metal debris when the hybrid cap bolts 200 each configured from the metallic main body 210 having the same material as the tuning bolt and the coupling threads 220 each having the outer surface made of an ULTEM material are coupled to the air blowing work holes 11 and 110.

Meanwhile, in the embodiment of the present invention, the plurality of air blowing work holes 11 and 110 are provided such that an air blowing work may be performed to blow air through the work holes 11 formed in the upper plate 10, and an air suctioning work may be performed to suction air through the work holes 110 formed in the outer sidewall 100 of the housing.

As described above, according to the present invention, there is an effect of providing a cavity filter for low PIMD using hybrid cap bolts, which can remove metal debris present inside a cavity housing by an air blowing method using air blowing work holes formed in a cavity housing and hybrid cap bolts for reducing PIMD while preventing the generation of additional metal debris.

In addition, the present invention has an effect in that the outer surface of the main body of each hybrid cap bolt is formed of an ULTEM material, and thus, the coupling is firmly fixed with a repulsive force when the hybrid cap bolt is screwed into the air blowing work hole.

So far, the present invention has been described in detail. However, it is clarified that the above-described embodiments are merely exemplarily provided and do not limit the invention, and it will be understood that modifications of components of such a degree that can be equivalently replaced without departing from the spirit and scope of the invention as provided by the appended claims will fall within the scope of the present invention.

What is claimed is:

1. A cavity filter for low PIMD (passive intermodulation distortion) using a plurality of hybrid cap bolts, comprising:

a housing having therein a plurality of cavities partitioned by separation walls and an open upper portion;

an upper plate coupled onto the upper portion of the housing and provided therein with a plurality of tuning bolts;

a plurality of air blowing work holes formed respectively on the upper plate and outer sidewalls of the housing and corresponding to the plurality of cavities; and the plurality of hybrid cap bolts formed of different kinds of materials of metal and non-metal so as to be respectively coupled to the plurality of air blowing work holes with a repulsive force against the plurality of air blowing work holes, wherein each of the plurality of hybrid cap bolts comprises:

a main body including a metallic cap section and a metallic body section and being inserted into each of the plurality of air blowing work holes, and a coupling thread formed of a dielectric material by injection molding on an outer surface of the main body to surround the metallic body section of the main body and provided on an outside thereof with threads to be coupled to each of the plurality of air blowing work holes to thereby seal the plurality of air blowing work holes, and wherein each of the plurality of air blowing work holes comprises a groove part on which the metallic cap section of each of the plurality of hybrid cap bolts is mounted.

2. The cavity filter of claim 1, wherein at least one of the coupling threads is made of a polyetherimide (PEI) resin plastic material.

3. The cavity filter of claim 1, wherein the respective coupling threads are formed by forming the corresponding main body by an insert injection molding method.

4. The cavity filter of claim 1, wherein the plurality of air blowing work holes are provided such that:

a blowing work is performed to blow air through the plurality of air blowing work holes formed in the upper plate, and a suctioning work is performed through the plurality of air blowing work holes formed in the outer sidewalls of the housing.

* * * * *